US008556355B2

(12) United States Patent
Greenberg

(10) Patent No.: US 8,556,355 B2
(45) **Date of Patent: *Oct. 15, 2013**

(54) METHOD AND APPARATUS FOR OPTIMIZING STORAGE SPACE

(76) Inventor: Bertram M. Greenberg, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/359,887

(22) Filed: Jan. 27, 2012

(65) Prior Publication Data

US 2012/0194042 A1 Aug. 2, 2012

Related U.S. Application Data

(63) Continuation-in-part of application No. 12/252,500, filed on Oct. 16, 2008, now Pat. No. 8,113,606, which is a continuation-in-part of application No. 12/238,161, filed on Sep. 25, 2008, now abandoned, which is a continuation of application No. 11/113,382, filed on Apr. 23, 2005, now abandoned.

(60) Provisional application No. 60/960,830, filed on Oct. 16, 2007.

(51) Int. Cl.
*A47B 81/00* (2006.01)

(52) U.S. Cl.
USPC ..... 312/201; 312/271

(58) Field of Classification Search
USPC ..... 312/107, 108, 111, 306, 312, 249.8, 312/249.11–249.13, 291, 311, 271–276, 312/325, 247, 248, 201, 334.15, 334.18, 312/334.33, 334.39, 198
See application file for complete search history.

(56) References Cited

U.S. PATENT DOCUMENTS

| | | | | |
|---|---|---|---|---|
| 264,748 | A * | 9/1882 | Potts | 312/201 |
| 363,595 | A | 5/1887 | C'laus | |
| 730,046 | A | 6/1903 | Price | |
| 841,813 | A * | 1/1907 | Plummer | 190/17 |
| 973,573 | A | 10/1910 | Sims | |
| 1,315,922 | A * | 9/1919 | Franklin | 108/143 |
| 1,425,259 | A | 8/1922 | Thomas | |
| 1,583,971 | A | 5/1926 | Hammond et al. | |
| 1,644,716 | A | 10/1927 | Fain | |
| 1,798,800 | A | 3/1931 | MacKnight | |
| 1,854,756 | A | 4/1932 | Muller | |

(Continued)

FOREIGN PATENT DOCUMENTS

GB 2223670 A 4/1990

OTHER PUBLICATIONS

"Southern Home Comforts" http://www.southernhomecomforts.com/store/downrods.asp, available Oct. 2004, accessed Aug. 20, 2007.

(Continued)

*Primary Examiner* — Janet M Wilkens
(74) *Attorney, Agent, or Firm* — Blank Rome LLP

(57) ABSTRACT

An adaptable furniture system includes at least one first article of furniture and at least one second article of furniture. The adaptable furniture system further includes a moving system for moving at least one of the at least one first article of furniture and the at least one second article of furniture, where a forward movement of the at least one second article of furniture is associated with a lowering movement of the at least one first article of furniture.

10 Claims, 13 Drawing Sheets

(56) References Cited

U.S. PATENT DOCUMENTS

| | | | | | |
|---|---|---|---|---|---|
| 2,268,917 | A | * | 1/1942 | Abelmann | 312/273 |
| 2,375,581 | A | | 5/1945 | Pezzano | |
| 2,634,186 | A | | 4/1953 | Zuss | |
| 2,915,192 | A | | 12/1959 | Roma | |
| 2,927,696 | A | * | 3/1960 | Michaels et al. | 211/27 |
| 3,272,583 | A | * | 9/1966 | Averdieck | 312/334.38 |
| 3,285,682 | A | | 11/1966 | Nelson | |
| 3,379,482 | A | | 4/1968 | Baggott | |
| 3,415,586 | A | * | 12/1968 | Hammond | 312/312 |
| 3,734,588 | A | | 5/1973 | Ellis | |
| 3,768,676 | A | | 10/1973 | Spitzer | |
| 3,975,871 | A | | 8/1976 | Ghionda | |
| 3,980,364 | A | * | 9/1976 | Entrikin et al. | 312/334.18 |
| 4,082,250 | A | | 4/1978 | Allmon et al. | |
| 4,103,373 | A | | 8/1978 | Luedtke et al. | |
| 4,337,988 | A | | 7/1982 | Schenck | |
| 4,345,802 | A | | 8/1982 | Sorensen | |
| 4,412,601 | A | | 11/1983 | Cooper | |
| 4,859,008 | A | | 8/1989 | Eyre et al. | |
| 4,862,764 | A | | 9/1989 | Gehring | |
| 5,076,649 | A | * | 12/1991 | Therkelsen | 312/246 |
| 5,147,120 | A | | 9/1992 | Ray | |
| 5,199,843 | A | | 4/1993 | Sferra | |
| 5,242,217 | A | | 9/1993 | Gonnet | |
| 5,249,858 | A | | 10/1993 | Nusser | |
| 5,273,352 | A | | 12/1993 | Saper | |
| 5,296,791 | A | | 3/1994 | Hipp | |
| 5,475,949 | A | | 12/1995 | McCoy | |
| 5,507,570 | A | | 4/1996 | Williams et al. | |
| 5,857,756 | A | | 1/1999 | Fehre | |
| 5,871,070 | A | | 2/1999 | Contreras | |
| 6,048,044 | A | | 4/2000 | Biggel et al. | |
| 6,135,032 | A | | 10/2000 | Ko | |
| 6,250,728 | B1 | | 6/2001 | Thorp | |
| 6,425,151 | B2 | | 7/2002 | Barnett | |
| 6,471,311 | B1 | * | 10/2002 | Snyder | 312/247 |
| 6,484,893 | B1 | | 11/2002 | Tkatch | |
| 6,547,183 | B2 | | 4/2003 | Farnsworth | |
| D480,892 | S | | 10/2003 | White | |
| 6,663,334 | B2 | | 12/2003 | Warhurst et al. | |
| 6,663,336 | B2 | | 12/2003 | Fletcher et al. | |
| 6,676,233 | B1 | | 1/2004 | Evans et al. | |
| 6,752,475 | B2 | | 6/2004 | Steadman | |
| 6,755,492 | B1 | | 6/2004 | Hyde et al. | |
| 6,829,791 | B2 | | 12/2004 | Roepke | |
| 7,488,048 | B2 | * | 2/2009 | Paganini | 312/249.11 |
| 8,113,606 | B2 | * | 2/2012 | Greenberg | 312/271 |
| 2002/0178497 | A1 | | 12/2002 | Thurston | |
| 2004/0027037 | A1 | | 2/2004 | Krueger | |
| 2006/0238085 | A1 | | 10/2006 | Greenberg | |
| 2009/0021128 | A1 | | 1/2009 | Greenberg | |
| 2009/0179538 | A1 | | 7/2009 | Greenberg | |

OTHER PUBLICATIONS

"Hale Bookcases" http://www.biz2bizonline.com/hale/index.html, available Feb. 2005, accessed Aug. 20, 2007.

* cited by examiner

METHOD AND APPARATUS FOR OPTIMIZING STORAGE SPACE

CROSS-REFERENCE TO RELATED APPLICATIONS

This application claims priority to U.S. Provisional Patent Application Ser. No. 60/960,830, filed Oct. 16, 2007, the contents of which are incorporated herein by reference.

This application is a Continuation-In-Part of U.S. patent application Ser. No. 12/252,500, filed on Oct. 16, 2008, which is a Continuation-In-Part of U.S. patent application Ser. No. 12/238,161, filed Sep. 25, 2008, now abandoned, which is a Continuation of U.S. patent application Ser. No. 11/113,382, filed Apr. 23, 2005, now abandoned, the contents of which are incorporated herein by reference.

FIELD OF THE INVENTION

The present invention relates to a furniture system. More particularly, the present invention relates to a furniture system having optimized storage space.

BACKGROUND OF THE INVENTION

More and more, people are forced to inhabit increasingly small spaces. As a result, it is difficult to find sufficient storage space for their belongings. Much of the available storage space is usually the space right below the ceiling. This space remains unusable without a ladder due to the limitations of the human frame. The ladder requires balance and/or support, both of which are challenged when replacing or removing an object from this upper area.

SUMMARY OF THE INVENTION

In light of the difficulties of the background art, the inventor developed the present invention. To this end, a first non-limiting aspect of the invention provides an adaptable furniture system, which includes: at least one first article of furniture, at least one second article of furniture, and a moving system for moving at least one of the at least one first article of furniture and the at least one second article of furniture, where a forward movement of the at least one second article of furniture is associated with a lowering movement of the at least one first article of furniture.

DETAILED DESCRIPTION OF THE EMBODIMENTS

As a general rule, 33 inches is the maximum distance an average sized person can reach forward from their toe point onto, or across to, a shelf at a shoulder height with a minimum of bending and twisting. Additionally, 54 inches is the maximum height of a drawer that allows a user to be able to see and reach down into it. The maximum height of a shelf for most users is 68 inches from the floor. Thus, in a room with a ten-foot ceiling, approximately an additional 48 inches of vertical space immediately below the ceiling remain unused because it cannot be accessed without a ladder. Each of the following embodiments maximizes the advantages made available by the 33, 54, and 68 inch rules, while eliminating the need for a ladder. The present invention improves the safety and ease of use of additional storage areas (e.g., 4 feet directly below the ceiling). When used in a room with a ceiling between 8 and 10 feet high, this invention provides safe and easy access to approximately 50% of the storage space in an average home, office, or storage area.

A detailed description of non-limiting embodiments of the invention will now be described with reference to the drawings, in which like numerals represent like elements throughout. Through the present invention, it is possible to maximize the amount of available storage space.

Figure 1:
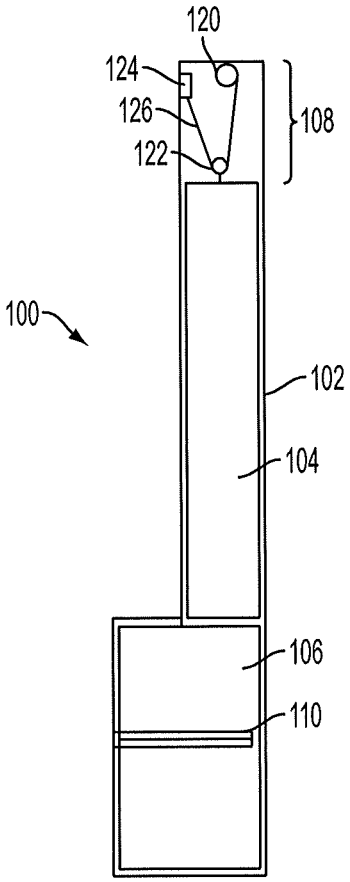
FIG. 1 is a side view of an adaptable furniture system according to a non-limiting exemplary embodiment of the present invention.

FIG. 1 shows a side view of an adaptable furniture system 100 according to an exemplary embodiment of the present invention. The furniture system 100 includes, among others, a frame 102, an upper cabinet 104, a lower cabinet 106, a moving system 108 and a sliding system 110. The frame 102 has an upper portion for receiving the upper cabinet 104 and a lower portion for receiving the lower cabinet 106. The moving system 108 may be attached to the frame 102 and the upper cabinet 104 for moving the upper cabinet up and down within the frame 102. The sliding system 110 may be attached to the frame 102 and the lower cabinet 106 such that the lower cabinet 106 may be easily moved forward or backward with respect to the frame 102.

Figure 2:
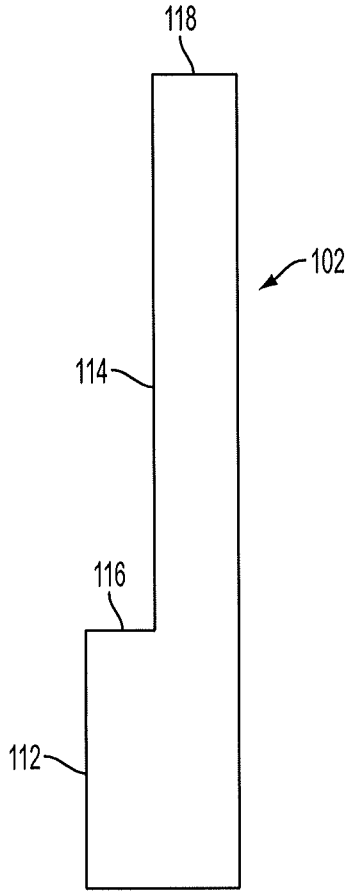
FIG. 2 is a side view of the frame of the furniture system of FIG. 1.

The frame 102, as shown in FIG. 2, includes front surfaces 112 and 114 as well as horizontal surfaces 116 and 118. The upper surface 118 of the frame 102 may be built as high as the ceiling of the room where the furniture system is located. The surfaces 116 and 118 may also be used for additional storage, if desired. If the upper surface 118 is used for additional storage, it may be built at a height lower than the height of the ceiling. To fully utilize the storage space right under the ceiling of a room, the upper surface 118 is preferably equal to or higher than 68 inches from the floor.

The frame 102 may be made from any suitable material. For example, the frame 102 may be made of wood, composite, polymers, or any other suitable materials known to those of skill in the art. As an option, the frame 102 may include interior or exterior supports to further strengthen the frame. The supports may be made from any suitable material, such as metal, wood, plastic, polymer, or the like, and may be adapted to appear as decorative features.

The front surfaces 112 and 114 may include decorative features (not shown). Additionally, the front surfaces 112 and 114 may include doors (not shown), which may be used to access the contents of the frame 102. The frame 102 may also include adaptable back surfaces (not shown), if desired.

Figure 3A:
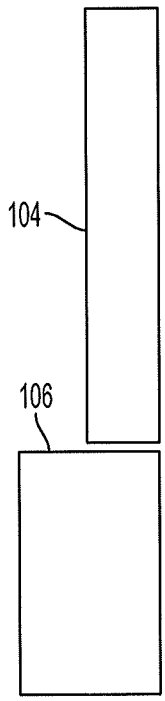
FIGS. 3(*a*)-3(*c*) illustrate various positions of the upper and lower cabinets inside the furniture system 100 of FIG. 1.
Figure 3B:
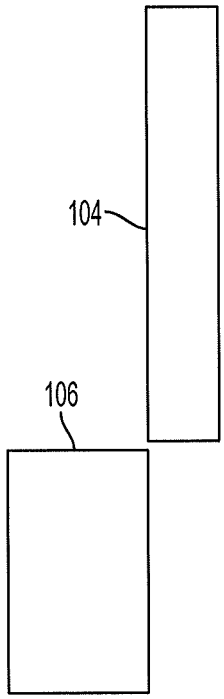
Figure 3C:
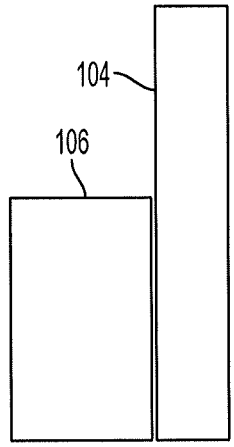

The upper cabinet 104 and the lower cabinet 106 are shown in FIGS. 3(*a*)-3(*c*) without the frame 102. In FIG. 3(*a*), the upper cabinet 104 and the lower cabinet 106 are in their fully retracted position inside the frame 102 where the upper cabinet 104 rests on top of the lower cabinet 106. As shown in FIG. 3(*a*), the lower cabinet 106 has greater depth than the upper cabinet 104. However, the depth of the upper cabinet 104 may also be equal to or greater than that of the lower cabinet 106.

In FIG. 3(*b*), the lower cabinet 106 is pulled forward to create a space within the frame 102 behind the lower cabinet 106. A portion or all of the upper cabinet 104 may then be lowered, as shown in FIG. 3(*c*).

Referring again to FIG. 1, the moving system 108 for lowering and raising the upper cabinet 104 may include a winch device 120, a leverage element 122, a securing anchor 124 and a cable 126. The winch device 120 and the securing anchor 124 are attached to the frame 102. The leverage element 122 is attached to the upper cabinet 104. The cable 126 is secured at one end to the winch device 120 and at another end to the securing anchor 124. A middle section of the cable 126 is movably attached to the leverage element 122 for supporting and suspending the upper cabinet 104. The securing anchor 124 may include a bracket, hook, clamp, or other suitable devices for securing known to those of skill in the art.

Figure 4:
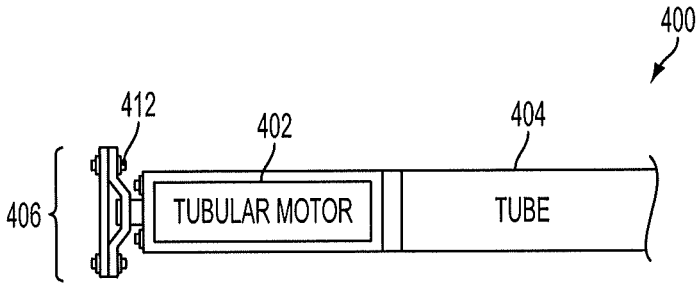
FIG. 4 is an exemplary winch system according to a non-limiting aspect of the present invention.

The winch device 120 may incorporate any devices for raising and lowering heavy objects known to those of skill in the art. For example, the winch device 120 may include motor elements, as depicted in FIG. 4.

The leverage element 122 may be detachably or permanently attached to a top surface of the upper cabinet 104. In the exemplary embodiment of FIG. 1, the leverage element 122 includes a pulley. Of course, other leverage elements, such as cranks and hoists, may be used. Additionally, although the pulley 122 of FIG. 1 is depicted at approximately a center of the upper surface of the upper cabinet 104, other positions are also within the scope of the present invention.

The moving system 108 may also be detachably or permanently attached to one or any combination of the front, top, back and side surfaces of the frame 102, as desired.

Figure 9:
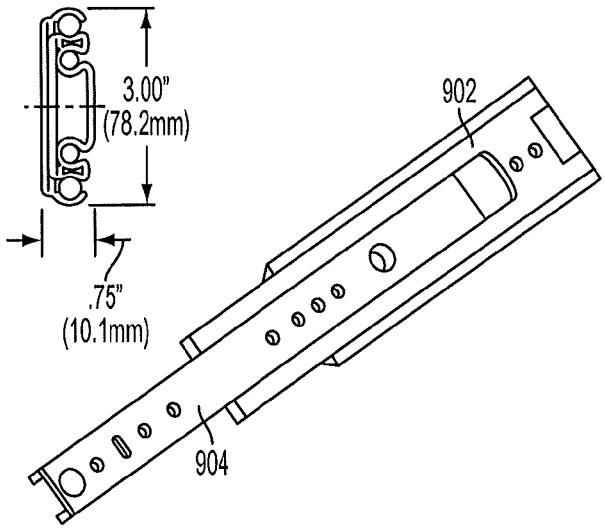
FIG. 9 is an exemplary sliding system.
Figure 10:
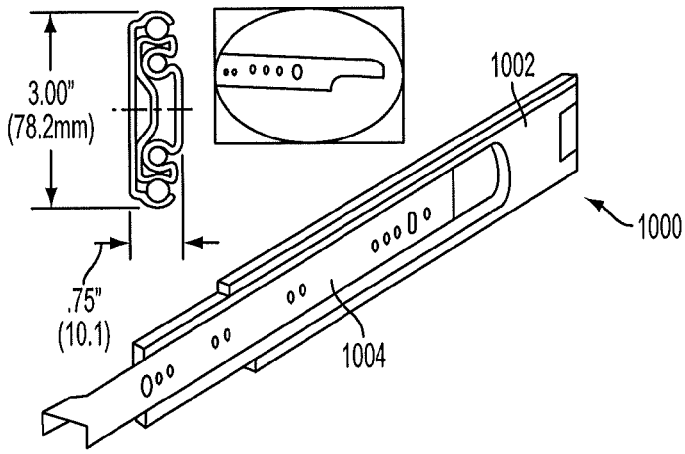
FIG. 10 is another exemplary sliding system.

The sliding system 110 may be drawer-type sliders, such as sliders 900 and 1000 shown in FIGS. 9 and 10, respectively. These sliders are used to support the lower cabinet 106 as the lower cabinet 106 is pulled forward or pushed backward. In the examples of FIGS. 9 and 10, each slider includes a track 902 (or 1002) mounted to an interior side of the frame 102, and a sliding part 904 (or 1004) mounted to a corresponding location on the lower cabinet 106 to cooperate with the track 902 (or 1002). The sliding system 110, such as those in FIGS. 9 and 10, enables the lower cabinet 106 to be easily moved forward and backward. Other types of sliders known to those of skill in the art may be utilized for the sliding system 110.

FIG. 4 shows an exemplary winch system 400 that may be used for the winch device 120 in FIG. 1. Referring to FIG. 4, the winch system 400 may include a tubular motor 402, a tube 404 and a fastening element 406. The tubular motor 402 is attached to the tube 404 to form a bar. The tube 404 and an outer layer of the tubular motor 402 may be made of any suitable material such as polymer (PVC) or metal. The bar formed by 402 and 404 is fastened to the side surfaces or top surface of the frame 102 in FIG. 1 using fastening elements 406. Each of the fastening elements 406 may include, for example, a nut and bolt assembly 408.

Figure 5A:
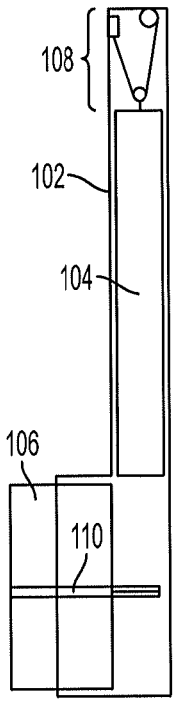
FIGS. 5(*a*)-5(*c*) illustrate various positions of the upper and lower cabinets inside the furniture system 100 using an exemplary pulley lifting system.
Figure 5B:
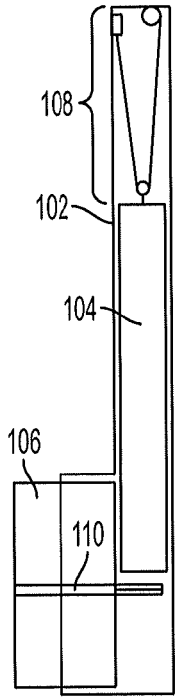
Figure 5C:
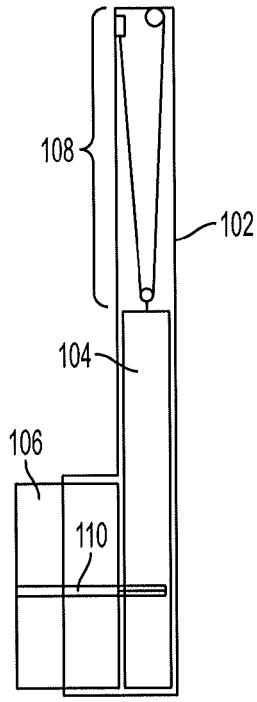

FIGS. 5(*a*)-5(*c*) show various positions of the furniture system 100 of FIG. 1. FIG. 5(*a*) shows the lower cabinet 106 being pulled forward a sufficient amount such that the upper cabinet 104 may be lowered. FIG. 5(*b*) shows the upper cabinet 104 being partially lowered. As shown in FIG. 5(*b*), the upper cabinet 104 can easily be lowered into the space within the frame 102 previously occupied by the lower cabinet 106. FIG. 5(*c*) illustrates the upper cabinet 104 in a fully lowered position. By lowering the upper cabinet 104, the uppermost area of the upper cabinet 104 may be accessed as desired, without a ladder. The uppermost area of the upper cabinet 104 is preferably at least 68 inches above the floor. Although not shown, the upper cabinet 104 may be raised again and the lower cabinet 106 may be returned to its original position when desired.

The illustrations in FIGS. 5(*a*)-5(*c*) show that the opening (or pull-forward) of the lower cabinet 106 enables the lowering of the upper cabinet 104, and the raising of the upper cabinet 104 enables the retraction of the lower cabinet 106.

Figure 6:
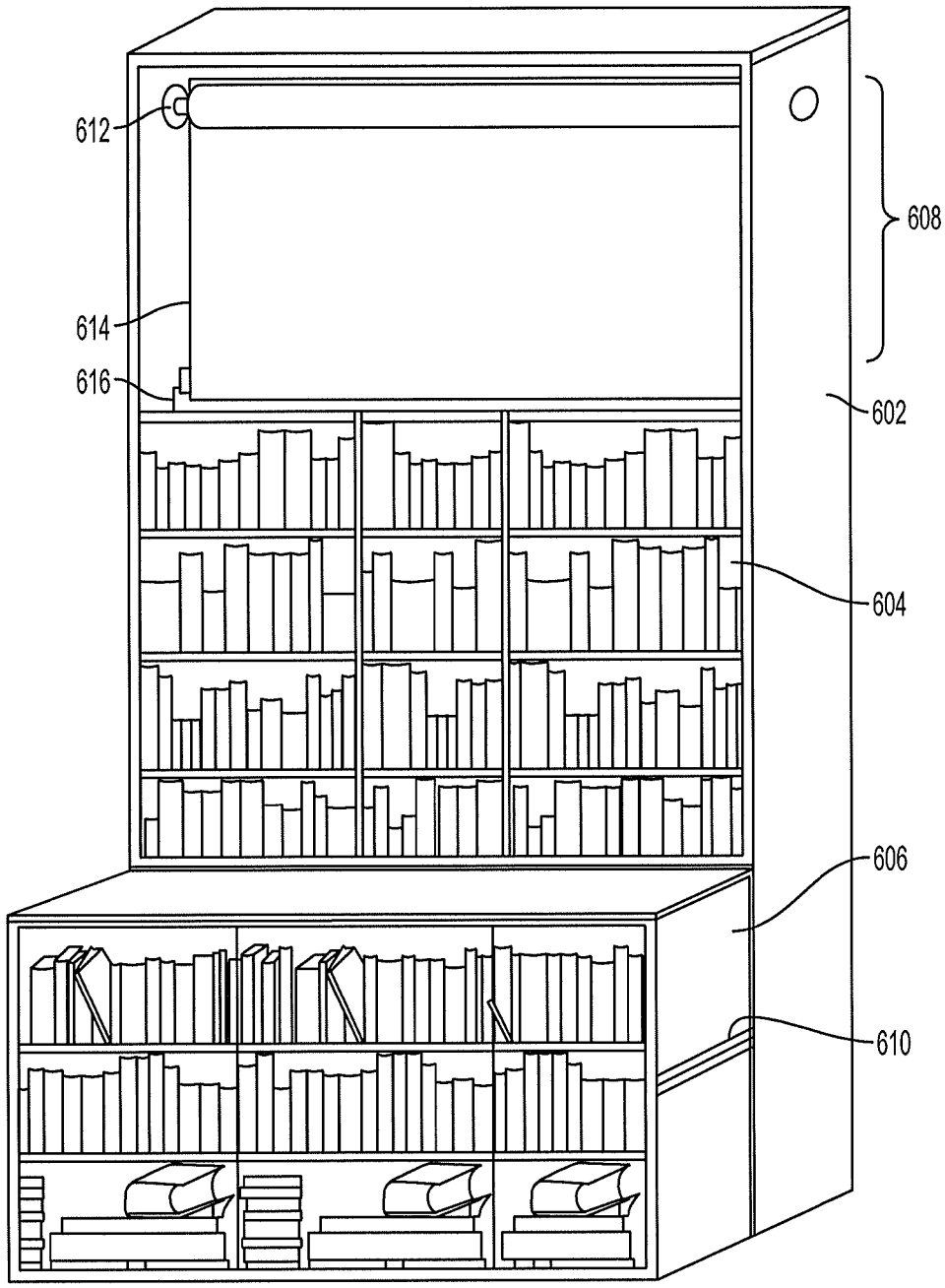
FIG. 6 is a front view of the exemplary embodiments of FIGS. 1 and 5(*a*)-5(*c*)

FIG. 6 provides a front view of a furniture system 600 according to another exemplary furniture system of the present invention. Similar to the furniture system 100 of FIG. 1, the furniture system 600 includes a frame 602, an upper cabinet 604, a lower cabinet 606, a moving system 608 and a sliding system 610. The moving system 608 includes a winch device 612, a suspending system 614, and a leverage element 616. The suspending system 614 may include cables or a sheet of durable plastic or the like. In FIG. 6, the upper cabinet 604 and the lower cabinet 606 are used as bookshelves and have the same depth. In addition, the lower cabinet 606 is pulled forward and the upper cabinet 604 is in a lowered position.

In FIGS. 1, 5(*a*)-5(*c*) and 6, the moving system 108 and the sliding system 110 are shown as two separate systems. Alternatively, the moving system 108 and the sliding system 110 may be interconnected such that a forward movement of the lower cabinet 106 will cause a lowering movement of the upper cabinet 104, and a raising movement of the upper cabinet 104 will cause a backward movement of the lower cabinet 106.

Other alternative moving systems known to those skilled in the art, such as a counterweight system, may be used to raise and lower the upper cabinet 104. These alternative systems are within the scope of this invention.

Figure 7:
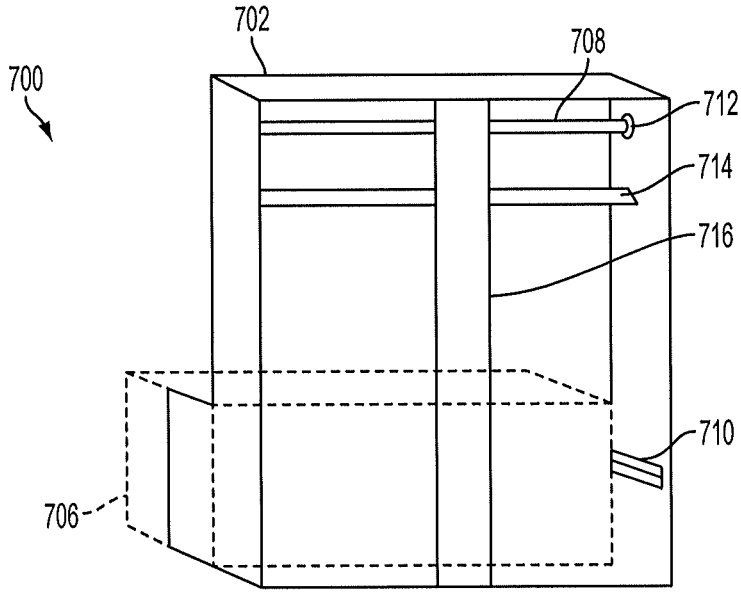
FIG. 7 is a back view of a frame according to another aspect of the present invention.

FIG. 7 shows a back view of a furniture system 700 according to another exemplary embodiment of the invention. The furniture system 700 includes a frame 702, an upper cabinet 704 (not shown) and a lower cabinet 706. The upper cabinet 704 and the lower cabinet 706 may be similar to those in FIG. 1. The furniture system 700 in FIG. 7 further includes a lifting device 708, drawer-type sliders 710, a tilt stop 714, and a vertical sliding guide 716.

The drawer-type sliders 710 in FIG. 7 is attached to the frame 702 and the lower cabinet 706 in order to assist the lower cabinet 706 in being pulled forward or retracted into the frame 702. Other objects, such as wheels or castors (not shown) on the lower cabinet 706 may be used as an alternative or in combination with the drawer sliders 710 to assist with its movement. The dashed lines in FIG. 7 represent the position of the lower cabinet 706 after it has been pulled forward.

The lifting device 708 has a tubular shape and is attached to two sides of the frame 702 by fastening elements 712. The lifting device 708 may include a motor, such as the winch system 400 in FIG. 4, or a counterweight system.

The tilt stop 714 includes a bar attached horizontally across the back of the frame 702. The tilt stop 714 is attached to the frame 702 to prevent the upper cabinet 704 (not shown) from tilting when the upper cabinet 704 is raised and lowered.

Figure 14A:
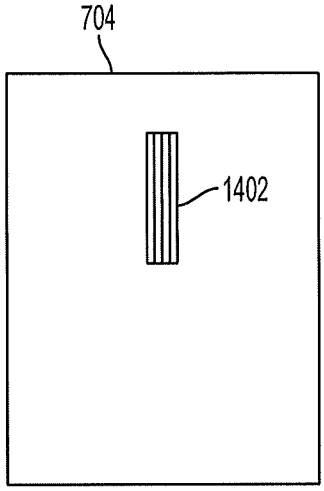
FIGS. 14(*a*) and 14(*b*) are additional non-limiting illustrations of slide guides according to exemplary aspects of the present invention.
Figure 14B:
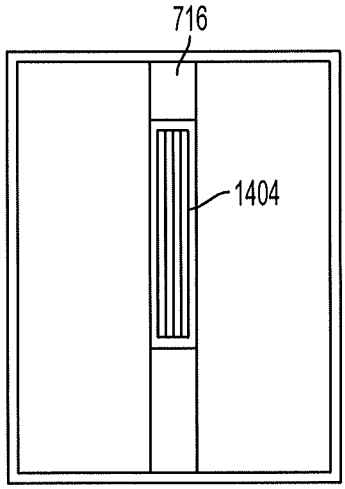

The vertical sliding guide 716 is also attached to the back of the frame 702 to stabilize the raising and lowering of the upper cabinet 704. As shown in FIG. 7, the sliding guide 716 is a panel mounted vertically to the back of the frame 702, approximately at the middle point between the two sides of the frame 702. The slide guide 716 may also be made in any form known to those skilled in the art, including both raised and recessed forms. The upper cabinet 704 may have a corresponding raised or recessed sliding guide, if desired, so that the upper cabinet 704 and the sliding guide 716 may cooperatively engage while raising and lowering the upper cabinet 704. FIGS. 14(*a*) and 14(*b*) provide non-limiting illustrations of an exemplary sliding guide including a slider 1402 (FIG. 14(*a*)) and a corresponding track 1404 (FIG. 14(*b*)). The slider 1402 in FIG. 14(*a*) may be attached to the back surface of the upper cabinet 704 and the track 1404 in FIG. 14(*b*) may be attached to the vertical back panel 716 of the frame 702. The slider 1402 fits inside the track 1404 to support the moving of the upper cabinet 704. Although FIGS. 14(*a*) and 14(*b*) show only one sliding guide, more than one sliding guide may be used for supporting the lowering and raising the upper cabinet 704. The positioning and arrangement of these sliding guides is for illustration purposes, and the sliding guides may be in any position deemed suitable.

Figure 8:
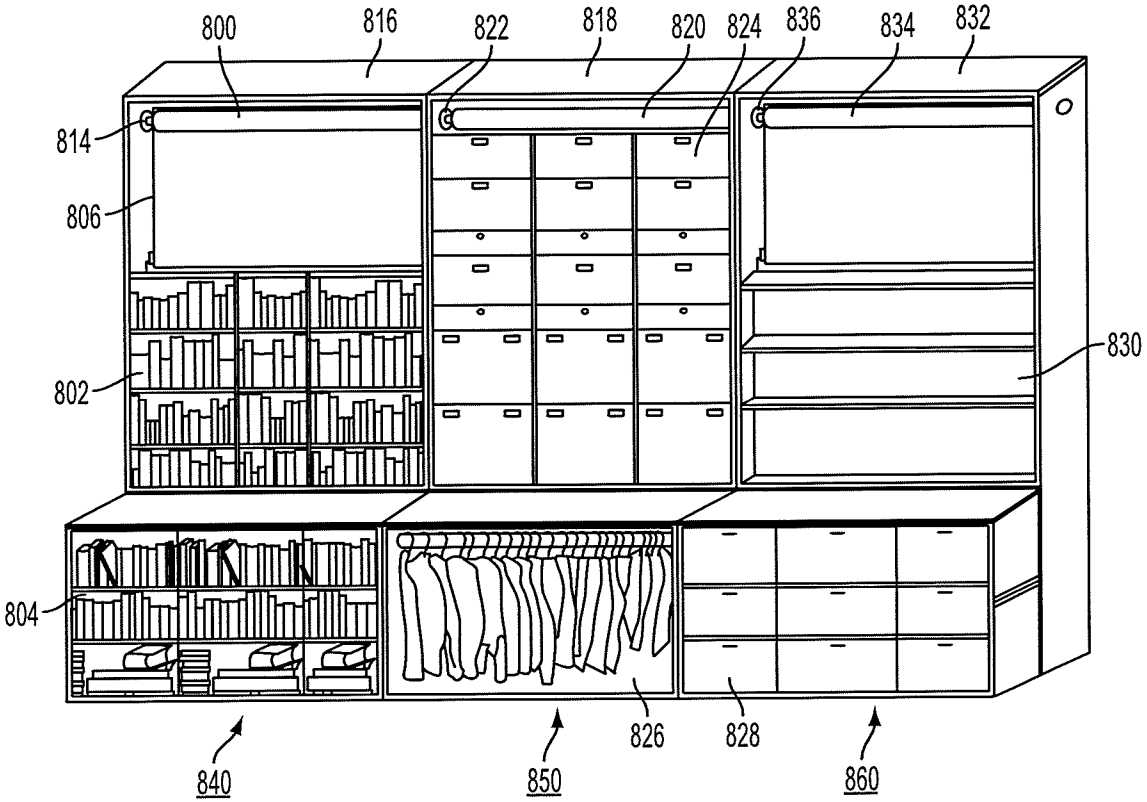
FIG. 8 is a front view of another exemplary embodiment of the present invention.

A plurality of the furniture systems 100 of FIG. 1 may be made and positioned next to each other. For instance, FIG. 8 shows a furniture system including three furniture systems 840, 850 and 860 positioned adjacent each other, wherein each of the furniture systems 840, 850, and 860 is similar to the system 100 of FIG. 1. FIG. 8 demonstrates that the furniture systems of the present invention have nearly unlimited uses. For example, the first system 840 includes a frame 816, an upper cabinet 802 and a lower cabinet 804. In the first system 840, the upper cabinet 802, which is illustrated in a lowered position and suspended on a cable 806, is used as a bookshelf. Likewise, the lower cabinet 804 is used as a bookshelf. A winch system 800, which may be affixed to the frame 816 by a fastening element 814, may be used to raise and lower the upper cabinet 802.

The second system 850 includes a frame 818, an upper cabinet 824 and a lower cabinet 826. In the second system 850, frame 818 is positioned adjacent to the frame 816 of the first system 840. The upper cabinet 824 is illustrated as a filing system, while the lower cabinet 826 is illustrated as a hanging closet area. A winch system 820, which is affixed to the frame 818 by a fastening element 822, may be used to raise and lower the upper cabinet 824.

Finally, the third system 860 includes a frame 832, an upper cabinet 830 and a lower cabinet 828. The frame 832 is positioned adjacent to frame 818 of the second system 850. The upper cabinet 830 is functioning as shelving, while the lower cabinet 828 is adapted to function as filing cabinets. The upper cabinet 830 is illustrated in FIG. 8 in a lowered position. A winch system 834, which is affixed to the frame 832 by fastening element 836, may be used to raise and lower upper cabinet 830 as desired.

Although not illustrated, any of the frames described as part of the furniture system may be securely attached to a wall, if desired. Conventional attachment methods known to those of skill in the art may be used. For example, the frame may be affixed using any type of screws, preferably to a stud or other secure wall feature.

Figure 11C:
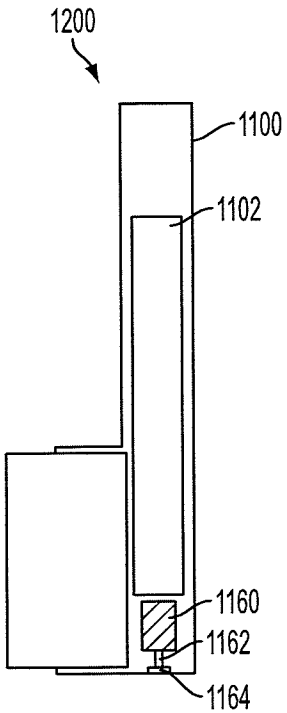
FIGS. 11(*a*), 11(*b*), and 11(*c*) are a furniture system according to another embodiment of the present invention.
Figure 11B:
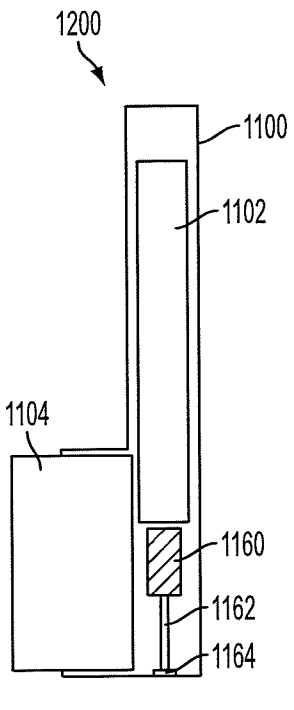
Figure 11A:
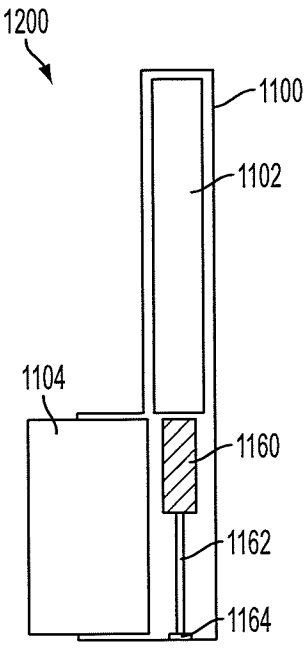

FIGS. 11(*a*)-11(*c*) and 12 illustrate a furniture system 1200 according to yet another exemplary embodiment of the present invention. The furniture system 1200 in FIGS. 11(*a*)-11(*c*) and 12 include a frame 1100, an upper cabinet 1102 and a lower cabinet 1104. The furniture system 1200 in FIGS. 11(*a*)-11(*c*) further includes a lifting system mounted to the bottom part of the upper cabinet 1102 for raising and lowering the upper cabinet 1102. The lifting system includes a pressing cylinder 1160, a piston 1162, and a base 1164. The lifting system may be secured to the frame or floor using the base 1164 and any suitable means for securing such as screws, bolts, nails, etc. The pressing cylinder 1160 may be gas, hydraulic, electrical, mechanical, or any other suitable type known in the art.

In FIG. 11(*a*), the upper cabinet 1102 is in a fully raised position. FIG. 11(*b*) illustrates the upper cabinet 1102 partially lowered by the pressing cylinder 1160 within the frame 1102. The lower cabinet 1104 is in a partially pulled-out position, so that the upper cabinet 1102 may be lowered. FIG. 11(*c*) shows the upper cabinet 1102 in a fully lowered position. If the lifting system is mounted to the bottom of the upper cabinet 1102 as shown in FIG. 11(*a*), the lower cabinet may be in a permanently or semi-permanently extended state, if desired.

Figure 12:
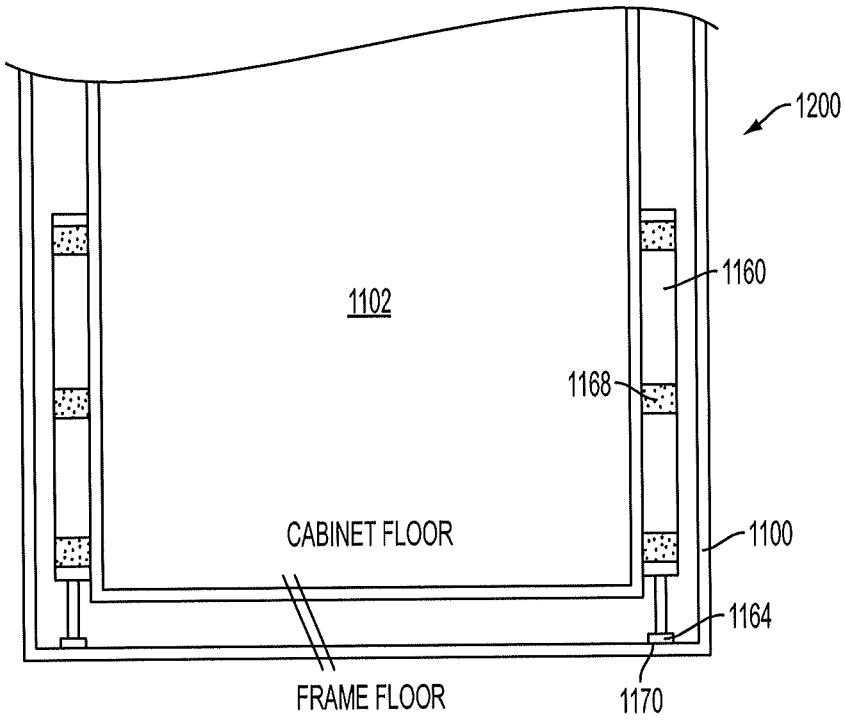
FIG. 12 illustrates another exemplary attachment position of the lifting system shown in FIGS. 11(*a*)-11(*c*)
Figure 13A:
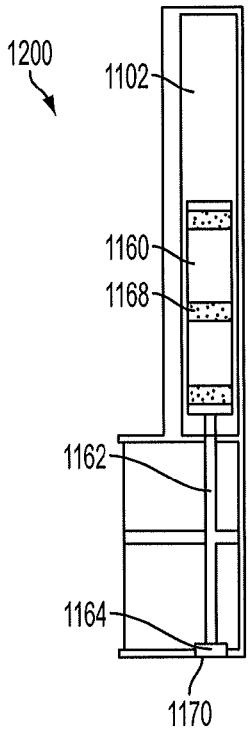
FIGS. 13(*a*)-13(*c*) are side views of the furniture system shown in FIG. 12.
Figure 13B:
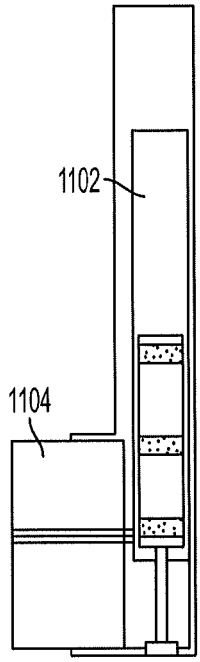
Figure 13C:
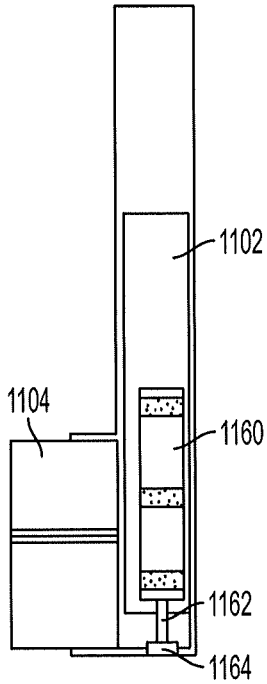

FIG. 12 shows a back view of the furniture system 1200 according to another exemplary embodiment of the invention. The furniture system 1200 of FIG. 12 is similar to that of FIG. 11(*a*) except, in FIG. 12, the lifting system is mounted to the sides, rather than the bottom, of the upper cabinet 1102. In FIG. 12, the pressing cylinders 1160 are secured to the sides of the upper cabinet 1102 by fastening elements 1168. The base 1164 of the piston 1162 may be secured to the floor or the frame 1100 by fastening elements 1170. The fastening elements 1168 and 1170 can be screws, bolts, clamps, nails, etc. FIGS. 13(*a*)-13(*c*) illustrate a side view of the furniture system 1200 with the cylinders being mounted to the sides of the upper cabinet 1102. FIG. 13(*a*) shows the upper cabinet 1102 being fully raised by the lifting system and the lower cabinet 1104 being fully retracted to the back of the frame 1102. FIG. 13(*b*) shows the lower cabinet 1104 being pulled forward and the upper cabinet 1102 being partially lowered by the lifting system 1160-1164. FIG. 13(*c*) shows the upper cabinet 1102 being fully lowered by the lifting system 1160-1164.

Although the lifting system is illustrated in specific positions for ease of reference in FIGS. 11(*a*)-11(*c*) and 12, this positioning is for illustrative purposes only and is not limiting of the invention. All suitable positions are within the scope of the present invention.

Each of the non-limiting embodiments described above may include safety stops (not shown) at appropriate positions to prevent accident or injury to a user.

By way of further non-limiting example, an upper cabinet according to the present invention may have a height of approximately 70 inches. A corresponding lower cabinet may have a height of approximately 40 inches. A winching system may occupy the remaining approximately 6-10 inches in a frame built to occupy a room having a 10-foot ceiling.

The respective depths of the upper and lower cabinets may be developed as desired. In one example, an upper cabinet may have a depth of approximately 10 inches if it is to be used as a bookcase. Alternatively, if the upper cabinet is to be used as a kitchen pantry, it may have a depth of 6 inches. Optionally, the lower cabinet may have a depth of approximately 33 inches.

Although the term "cabinet" is used to describe the upper and lower cabinets throughout the foregoing non-limiting description, it is important to note that these elements may be any article or type of furniture. In addition, the present invention is not limited to the articles of furniture selected. For example, the lower interior element may include a chest of drawers, while the upper cabinet may be a set of shelves. Alternative configurations include any combinations of drawers, shelves, or other furniture, including, but not limited to, desks, couches, gym equipment, cabinets, chairs, tables, entertainment centers, as well as all articles of furniture known to those skilled in the art.

The present invention may also include, as an optional feature, an alarm system to indicate any number of undesirable conditions. For example, the alarm system may be configured to warn that an obstruction is blocking the upper cabinet from ascending or descending. The obstruction may be a person's hand, the lower cabinet, or anything else in the way of the upper cabinet. The alarm system may also be configured to warn that the descent or ascent of the upper cabinet is not operating properly. Of course, these conditions are merely examples and any condition within the knowledge of one of skill in the art may be included.

Although the illustrated non-limiting embodiments do not show cabinet doors as a front part of the frame, doors or any decorative furniture elements may be included as desired. For example, any of frames 816, 818, and 832 in FIG. 8 may include a front door or doors as an aspect of the system. In an embodiment where the lower cabinet has an equal depth to the upper cabinet, a single door may be used to cover a front of these frames. Alternatively, any combination of any different number of doors may be used as desired. Other decorative features, such as glass covers, may also be used if desired.

Figure 15B:
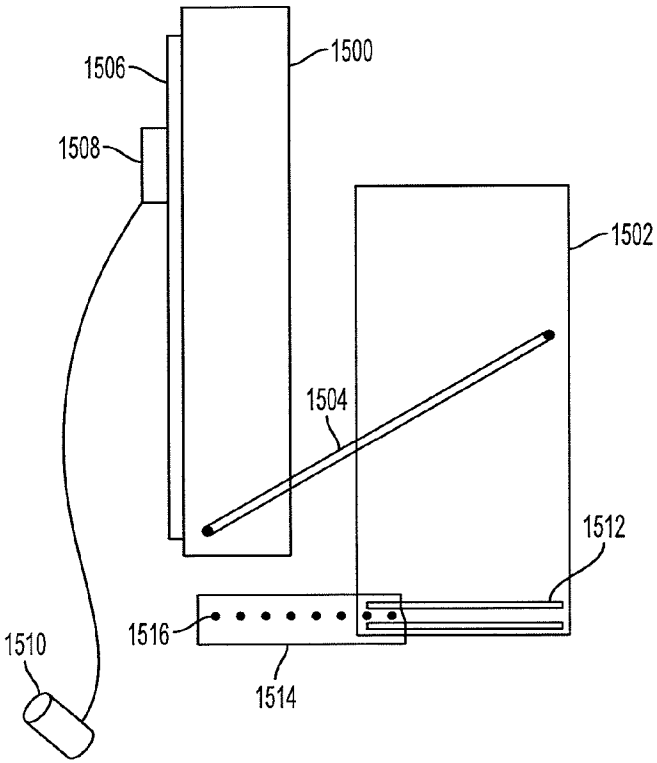
FIGS. 15(*a*) and 15(*b*) are side views illustrating various positions of the first and second articles of furniture of the multi-piece furniture system according to a non-limiting exemplary embodiment of the present invention.
Figure 15A:
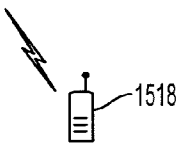
Figure 15A:
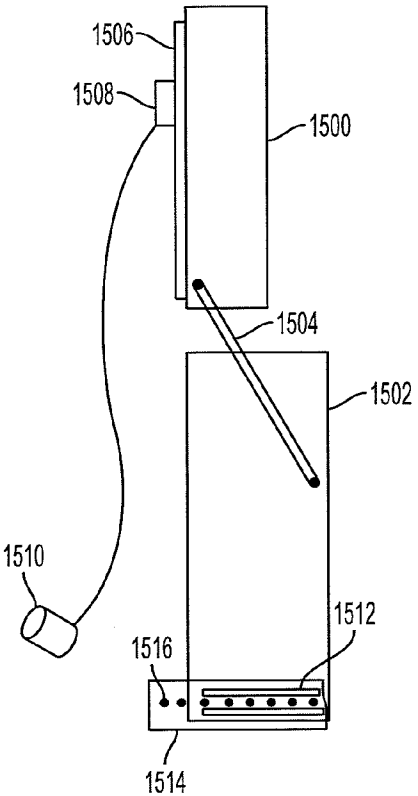

Additionally, as shown, for example, in FIGS. 15(*a*)-15(*b*), a non-limiting embodiment of the invention provides an upper piece and a lower piece that are interconnected without a frame. FIGS. 15(*a*)-15(*b*) illustrate side views of various positions of the upper and lower articles of furniture of a multi-piece furniture system according to a non-limiting exemplary embodiment of the present invention. The upper and lower pieces may be moved and/or adjusted in a manner similar to that described in the foregoing embodiments. Also as described above, the first and second articles of furniture (hereinafter the first and second "articles") may include, for example, a shelf, a cabinet, a drawer, a dresser, a vanity, an entertainment center, a desk, or a hanging rod. The first and second articles may be moveable relative to one another without the use of a frame that encases the first and second articles. Instead, a first guiding means may be fixed to a wall or other vertical surface for guiding (e.g., slidably) the first article vertically between a first position where the first article is located at its highest point and a second position where the first article is located at its lowest point. Similarly, a second guiding means may be fixed to a floor or other horizontal surface for guiding the second article horizontally (e.g., backward/forward) between a first position where the second article is located nearest the wall and beneath the first article, and a second position where the second article is located farther away from the wall and in front of the first article.

Turning now to FIG. 15(*a*), the first article 1500 and the second article 1502 are shown located in their respective first positions where the first article 1500 is located substantially above the second article 1502. The first article 1500 may be coupled to the second article 1502 by coupling means 1504. In one non-limiting example, the coupling means 1504 may include a rigid member that is attached at each terminal end via rotatable hinges. This allows for the first and second articles 1500 and 1502 to move relative to one another in a manner such that the distance between the attachment points of first and second articles 1500 and 1502 remains constant (i.e., the length of the coupling means 1504).

The first article 1500 may include a first guiding means 1506 such as a pair of guide rails which are affixed to the back portion of the first article 1500. A corresponding series of roller wheels may be affixed to a wall (not shown) for engaging with the pair of guide rails. In an alternate embodiment, the series of roller wheels may be affixed to the first article 1500 and the pair of guide rails may be affixed to the wall. Also, it is appreciated that other guiding means 1506 may be used without departing from the scope of the subject matter described herein. The guiding means 1506 ensures that the first article 1500 moves vertically rather than horizontally.

Similarly, the second article 1502 may include a second guiding means 1512 such as a pair of guide rails which are affixed to a bottom portion of the second article 1502. A corresponding series of roller wheels 1516 may be affixed to a floor (not shown) via mount 1514 for engaging with the pair of guide rails 1512. The guiding means 1512-1516 ensure that the second article 1502 moves backward/forward relative to the wall rather than vertically or horizontally (side-to-side). In one possible embodiment, the coupling means 1504 may be attached between the first article 1500 (as described above as the first attachment point) and the guiding means 1514, rather than the second article 1502. This may allow for a greater range of motion of the first and second articles 1500 and 1502 relative to one another, may provide a more secure anchor point for the coupling means 1504, and may limit any visually unappealing attachment points to the second article 1502.

A moving system may be configured for moving at least one of the first article of furniture 1500 and the at least one second article of furniture 1502, where a forward movement of the second article of furniture 1502 is associated with a lowering movement of the first article of furniture 1500. The moving system may comprise lifting system, a pulley, a winch, or a motor. Referring to FIG. 15(*a*), a movement means 1508 is shown connected to an electric motor 1510. Motor 1510 may be located anywhere including, but not limited to, above the first article 1500, below the first article 1500, or entirely separate from the first and second articles 1500 and 1502. The motor 1510 may control the movement means 1508 to lift or lower the first article 1500, where the movement of the first article 1500 is guided by the guiding means 1506. The operation of the motor 1510 may be controller by remote control 1518 which may be a wired or wireless device.

Turning now to FIG. 15(*b*), it may be appreciated that the first article 1500 and the second article 1502 are shown located in their respective second positions where the first article 1500 is located substantially behind the second article 1502. The first article 1500 remains the same distance from the wall because the first article 1500 has only moved downward and closer to the floor. By lowering the first article, this allows for a human operator to more easily reach items located on the first article 1500. However, the second article 1502 has moved forward relative to the wall as can be seen by the amount of railing 1512 that is exposed as a result of the horizontal movement of the second article via guiding means 1514 and 1516.

Figure 16B:
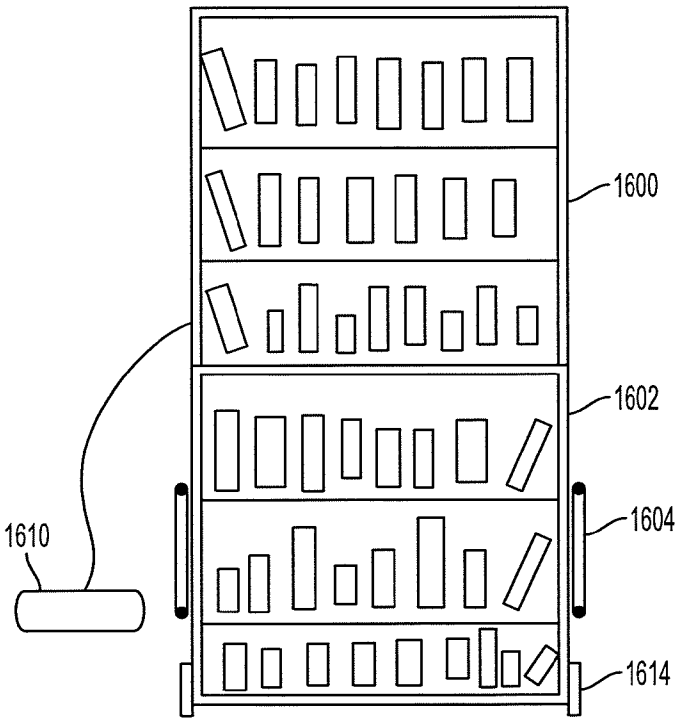
FIGS. 16(*a*) and 16(*b*) are front views illustrating the positions of the first and second articles of furniture of the multi-piece furniture system shown in FIGS. 15(*a*) and 15(*b*) according to a non-limiting exemplary embodiment of the present invention.
Figure 16A:
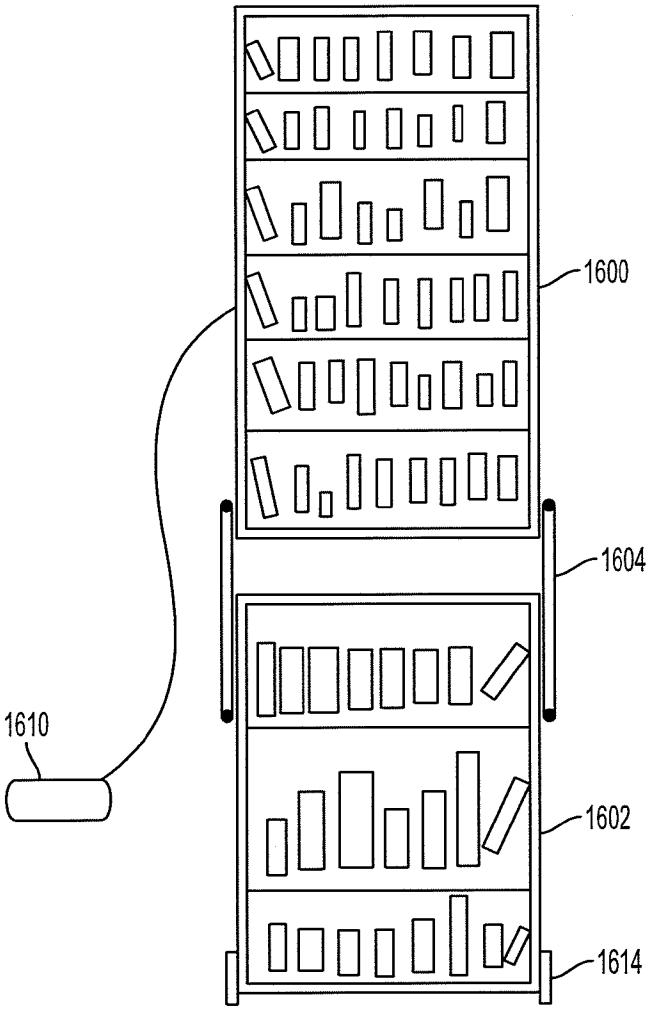

FIGS. 16(*a*)-16(*b*) illustrate front views of the positions of the upper and lower cabinets of the multi-piece furniture system shown in FIGS. 15(*a*)-15(*b*) according to a non-limiting exemplary embodiment of the present invention. Referring to FIG. 16(*a*), the first article 1600 and the second article 1602 are shown located in their respective first positions where the first article 1600 is located substantially above the second article 1602. The first article 1600 may be coupled to the second article 1602 by coupling means 1604. The coupling means 1604 may allow for the first article 1600 to move upward/downward and the second article 1602 to move forward/backward. In the illustrated example, the first and second articles 1600 and 1602 include book shelves, where the first article 1600 includes six visible bookshelves when located in the first position and the second article 1602 includes three visible bookshelves when located in the first position.

Referring to FIG. 16(*b*), the first article 1600 and the second article 1602 are shown located in their respective second positions where the first article 1600 is located substantially behind the second article 1602. Because the first article 1600 has been lowered, only three of its six shelves are visible, while the three shelves of the second article 1602 remain as visible and accessible as in the first position, but closer (i.e., farther forward). By lowering the first article 1600, previously inaccessible items can now be accessed. Because previously inaccessible items can be stored high up when the first article 1600 is located in the first position, space may be maximally utilized without the need for a ladder or similar means, which have various drawbacks as described above.

In addition to the embodiment described above with respect to FIGS. 15(*a*)-(*b*) and 16(*a*)-(*b*), it may be appreciated that other configurations for the moving system may be suitable for moving at the first article of furniture or the second article of furniture, where a forward movement of the second article of furniture is associated with a lowering movement of the first article of furniture without departing from the scope of the subject matter described herein. For example, the bottom portion of the first article 1600 and the top portion of the second article 1602 may be correspondingly angled (e.g., forty five degrees when viewed from the side) such that a wedge is formed (e.g., the bottom-front portion of the first article 1600 is higher than the bottom-back portion of the first article 1600). Thus, when the first article 1600 is lowered, the bottom wedge portion of the first article 1600 may physically contact the top wedge portion of the second article 1602. The downward force of the first article 1600 may thusly be translated into a horizontal force on the second article 1602, pushing the second article 1600 forward and into the second position.

The apparatus used to raise and lower the upper piece may also be positioned at any desired location. Similarly, the apparatus used to move the lower piece or pieces forward and backward may be at any desired location. Suitable devices include a lifting system, a pulley, a winch, or a motor, as described above. These devices may be operated by remote control, if desired, which may be either wired or wireless.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. An adaptable furniture system, comprising:

at least one upper article of furniture;

at least one lower article of furniture located below the at least one upper article of furniture; and a moving system for moving at least one of the at least one upper article of furniture and the at least one lower article of furniture, the moving system including a lifting system for moving the at least one upper article of furniture vertically, the lifting system including at least one vertical guide rail disposed on the at least one upper article of furniture, and a sliding system for moving the at least one lower article of furniture horizontally, and the sliding system including at least one horizontal guide rail affixed to the lower article of furniture configured to engage at least one roller wheel affixed to a floor, wherein a forward movement of the at least one lower article of furniture is associated with a lowering movement of the at least one upper article of furniture.

2. The adaptable furniture system according to claim 1, wherein the lifting system includes at least one of a pulley, a winch, or a motor.

3. The adaptable furniture system according to claim 1, wherein the at least one upper article and the at least one lower article include at least one of a shelf, a cabinet, a drawer, a dresser, a vanity, an entertainment center, a desk, or a hanging rod.

4. The adaptable furniture system according to claim 1, wherein the moving system is located: apart from the at least one upper article and the at least one lower article, above the at least one upper article, below the at least one upper article, or behind the at least one lower article.

5. The adaptable furniture system according to claim 1, wherein the at least one upper article is attached to the at least one lower article via one or more rigid members, the one or more rigid members being rotatably attached to the at least one upper and lower articles at a first attachment point and a second attachment point, respectively.

6. The adaptable furniture system according to claim 5, wherein the at least one upper article is moveable relative to the at least one lower article such that the first attachment point and the second attachment point maintain a constant distance defined by the length of the one or more rigid members.

7. The adaptable furniture system according to claim 1, wherein the adaptable furniture system is frameless.

8. The adaptable furniture system according to claim 1, wherein the moving system is operated by a remote control.

9. The adaptable furniture system according to claim 8, wherein the remote control is one of wired or wireless.

10. The adaptable furniture system according to claim 1, wherein at least a portion of the upper article is higher than 68 inches when located in a first position and the at least a portion of the upper article is lower than 68 inches when located in a second position.

* * * * *